US009254667B2

(12) United States Patent
Tanaka et al.

(10) Patent No.: US 9,254,667 B2
(45) Date of Patent: Feb. 9, 2016

(54) RECORDING APPARATUS

(71) Applicant: SEIKO EPSON CORPORATION, Tokyo (JP)

(72) Inventors: Yoshiyuki Tanaka, Matsumoto (JP); Yusuke Kimura, Matsumoto (JP); Taku Ishizawa, Matsumoto (JP); Hiroyuki Kawate, Hokuto (JP); Tokujiro Okuno, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/622,708

(22) Filed: Feb. 13, 2015

(65) Prior Publication Data

US 2015/0224777 A1 Aug. 13, 2015

(30) Foreign Application Priority Data

Feb. 13, 2014 (JP) ..... 2014-025129
Mar. 14, 2014 (JP) ..... 2014-051101

(51) Int. Cl.

| | |
|---|---|
| ***B41J 2/175*** | (2006.01) |
| ***B65D 33/06*** | (2006.01) |
| ***B65D 33/16*** | (2006.01) |
| ***B67D 7/02*** | (2010.01) |
| ***B67D 7/84*** | (2010.01) |

(52) U.S. Cl.

CPC ..... *B41J 2/175* (2013.01); *B65D 33/06* (2013.01); *B65D 33/16* (2013.01); *B67D 7/0294* (2013.01); *B67D 7/84* (2013.01)

(58) Field of Classification Search

CPC ..... B41J 2/175; B41J 2/1752; B41J 2/17509; B41J 2/17533
USPC ..... 347/7, 85, 86
See application file for complete search history.

(56) References Cited

U.S. PATENT DOCUMENTS

| | | | | |
|---|---|---|---|---|
| 6,027,209 | A * | 2/2000 | Menendez et al. | 347/85 |
| 6,779,880 | B1 * | 8/2004 | Kulpa et al. | 347/86 |
| 7,008,051 | B2 | 3/2006 | Akermalm | |
| 7,357,495 | B2 | 4/2008 | Matsumoto | |
| 8,491,109 | B2 * | 7/2013 | Takeda et al. | 347/85 |
| 8,540,352 | B2 * | 9/2013 | Igarashi | 347/85 |
| 8,678,567 | B2 * | 3/2014 | Shimizu et al. | 347/85 |

FOREIGN PATENT DOCUMENTS

| | | |
|---|---|---|
| JP | 2005-254570 | 9/2005 |

* cited by examiner

*Primary Examiner* — Anh T. N. Vo
(74) *Attorney, Agent, or Firm* — Workman Nydegger

(57) ABSTRACT

A recording apparatus includes a case, disposed outside a housing, holding a liquid holding member that holds a liquid to be supplied to a recording unit and having a discharge opening that discharges the liquid in the liquid holding member to the exterior, and a connection portion to which the discharge opening is connected. The case has a cover member capable of opening and closing the case by pivoting central to an axis line extending in a direction that intersects with a vertical direction, and a guide portion, provided on an inner surface of the cover member, that guides the liquid holding member when the liquid holding member is set in the case with the cover member in an open state so that the discharge opening of the liquid holding member is connected to the connection portion.

6 Claims, 11 Drawing Sheets

RECORDING APPARATUS

BACKGROUND

1. Technical Field

The present invention relates to recording apparatuses such as ink jet printers, for example.

2. Related Art

Ink jet printers that print (record) by ejecting ink from a liquid ejecting head (a recording unit) onto a recording medium such as paper have been known for some time as a type of recording apparatus. A configuration for such a printer has proposed in which ink is supplied from an ink bag (a liquid holding member) having a comparatively large ink holding capacity to the liquid ejecting head through an ink supply tube in order to continuously and stably supply ink to the liquid ejecting head in the case where a comparatively large printing job is to be executed (see U.S. Pat. No. 7,008,051, for example).

In a printer configured in this manner, the liquid ejecting head is normally mounted in a carriage that is provided so as to be capable of moving back and forth within a housing in a main scanning direction relative to the paper. The ink supply tube extending from the ink bag that is disposed outside of the housing is inserted into a movement region of the carriage through a gap formed in the housing, and is connected to the liquid ejecting head mounted in the carriage.

Incidentally, in a printer such as that described above, the configuration is such that a plurality of ink packs are stacked in a disorderly fashion, and thus there is a problem in that when replacing a desired ink pack, it is difficult to set a new ink pack.

Note that this problem is not limited to ink jet printers, and is generally common among recording apparatuses that record by ejecting, from a liquid ejecting head within a housing, a liquid that has been supplied to the liquid ejecting head from a liquid holding member disposed outside of the housing via a liquid supply tube.

SUMMARY

The invention has been conceived in light of such problems with past techniques. It is an advantage of some aspects of the invention to provide a recording apparatus in which a plurality of liquid holding members can be easily set in a set position within a case.

A summary of aspects of the invention for achieving the aforementioned advantage, and of effects of the invention, will be described below.

A recording apparatus according to an aspect of the invention includes a housing, a recording unit, disposed within the housing, that records by ejecting a liquid onto a recording medium, a case, disposed outside the housing, holding a liquid holding member that holds the liquid to be supplied to the recording unit and has a discharge opening that discharges the liquid in the liquid holding member to the exterior, and a connection portion to which the discharge opening is connected. Here, the case includes a cover member capable of opening and closing the case by pivoting central to an axis line extending in a direction that intersects with a vertical direction and a guide portion, provided on an inner surface of the cover member, that guides the liquid holding member when the liquid holding member is set in the case with the cover member in an open state so that the discharge opening of the liquid holding member is connected to the connection portion.

According to this configuration, when placing the liquid holding member into the case, the liquid holding member can be smoothly inserted into the case as a result of the guide portion. Accordingly, the liquid holding member can easily be set in the case.

In the recording apparatus, it is preferable that the guide portion be provided so as to cover at least a part of a hinge portion, in the cover member, that protrudes toward the inner surface when the cover member is in an open state.

According to this configuration, when a plurality of liquid holding members are set in set positions within the case, the liquid holding members can be suppressed by the guide portion from catching on at least a part of the hinge portion in the cover member that protrudes toward the inner surface.

In the recording apparatus, it is preferable that a visual confirmation portion that indicates a position corresponding to the liquid holding member is provided on a surface of the case that faces the guide portion.

According to this configuration, when the liquid holding member is set in the set position within the case, the liquid holding member can be precisely set in the set position within the case by using the visual confirmation portion as an indicator.

In the recording apparatus, it is desirable that the case includes a contact portion that makes contact with a base portion of the liquid holding member that has been set.

According to this configuration, the liquid holding member can be positioned by making contact with the base portion of the liquid holding member that has been set.

In the recording apparatus, it is desirable that the case includes a case forming member to which the cover member is attached via the hinge portion, the cover member is affixed to an end portion of the case forming member, and the guide portion covers the end portion of the case forming member when the cover member is in an open state.

According to this configuration, when a plurality of liquid holding members are set in set positions within the case, the plurality of liquid holding members can be suppressed by the guide portion from catching on the end portion of the case forming member.

In the recording apparatus, it is desirable that the base portion is bent by the contact portion making contact with the base portion.

According to this configuration, the base portion collapses as the amount of ink decreases, and thus the reduction in volume of the ink holding member can progress smoothly.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of a recording apparatus will be described hereinafter with reference to the drawings.

First Embodiment

Figure 1:
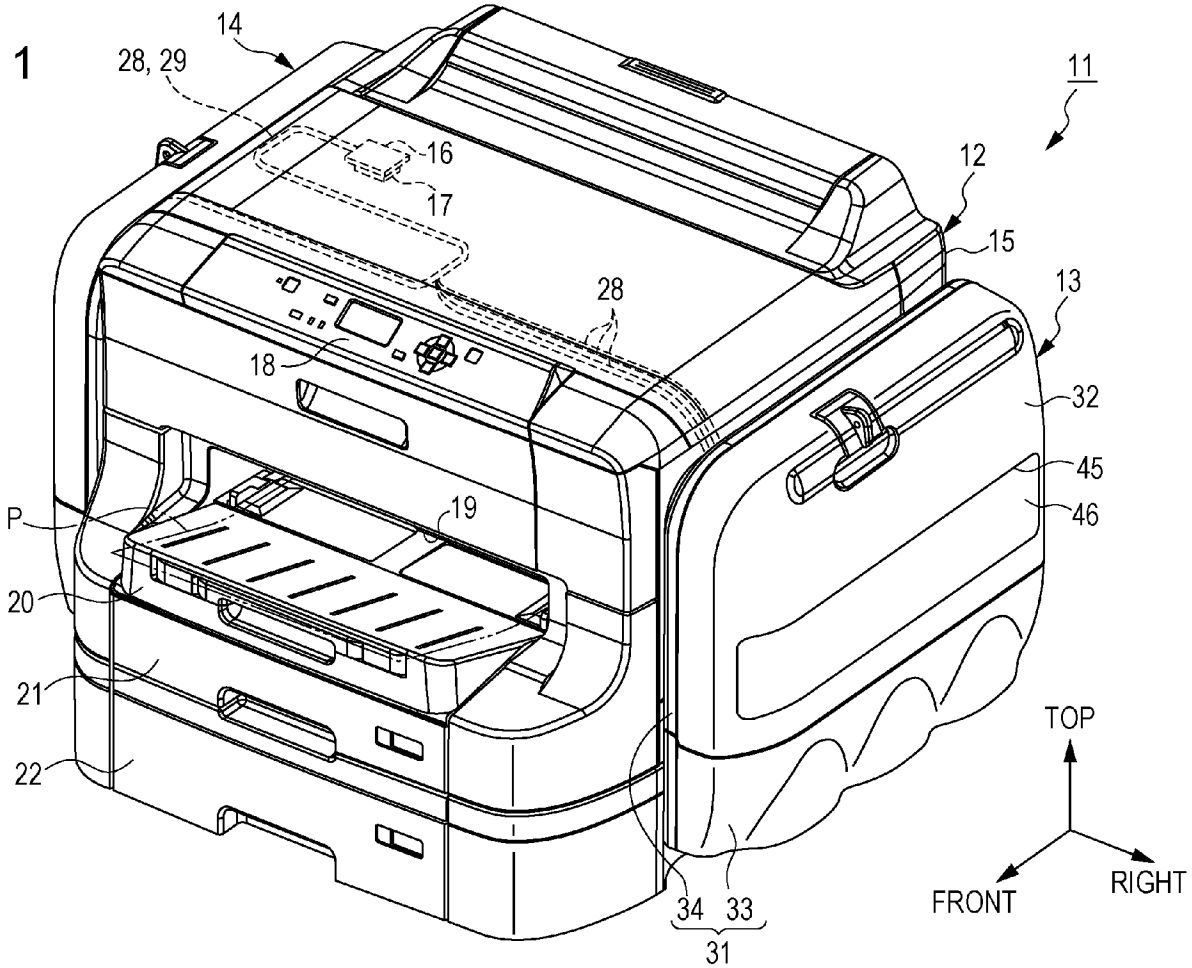
FIG. 1 is a perspective view of a recording apparatus.

As illustrated in FIG. 1, a recording apparatus 11 has an overall rectangular parallelepiped shape, and includes a recording unit 12 and liquid holding units 13 and 14 provided on both left and right side surfaces of the recording unit 12. The recording unit 12 includes a housing 15, and a carriage 16 is disposed within the housing 15 so as to be capable of moving back and forth in the left-right direction. A liquid ejecting head 17, serving as an example of a recording unit that prints (records) by ejecting ink (a liquid) onto paper P serving as an example of a recording medium, is supported on a lower end portion of the carriage 16.

An operating unit 18 for performing various types of operations in the recording apparatus 11 is provided on an upper end portion of a front end portion of the housing 15. A rectangular discharge port 19 from which the paper P printed onto within the housing 15 is discharged is provided in a central portion of a front surface of the housing 15. A rectangular plate-shaped discharge tray 20 that supports the paper P discharged from the discharge port 19 extends from the discharge port 19 so as to protrude toward the front, which corresponds to a discharge direction.

Upper and lower paper feed cassettes 21 and 22 are mounted in two stages, so as to be freely removable, below the discharge tray 20 in the front surface of the housing 15. Different sizes of paper P are held in the paper feed cassettes 21 and 22 in stacked states. Of course, the same size of the paper P may be held in the paper feed cassettes 21 and 22 as well.

Figure 2:
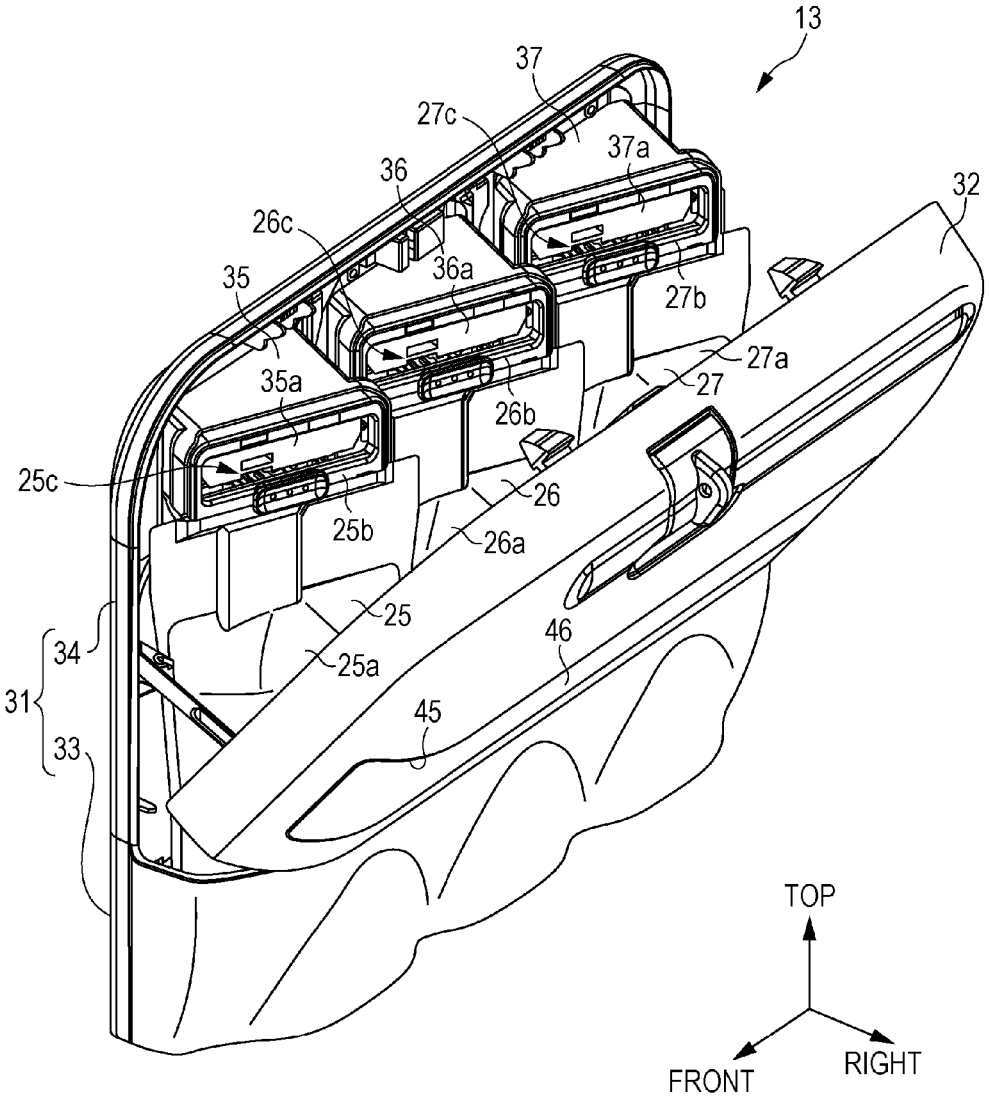
FIG. 2 is a perspective view of a liquid holding unit when a cover member has been opened.

As illustrated in FIGS. 1 and 2, a first ink holding member 25, a second ink holding member 26, and a third ink holding member 27, which serve as examples of liquid holding members that hold mutually different colors of ink (liquid), are held in the liquid holding unit 13 on the right side (on one side), so as to be arranged in a front-back direction, which is orthogonal to the left-right direction that serves as a movement direction of the carriage 16. The respective color inks held in the first-third ink holding members 25-27 are supplied to the liquid ejecting head 17 via respective ink supply tubes 28.

On the other hand, an ink holding member that holds black ink (liquid) (not shown) is held in the liquid holding unit 14 on the left side (another side), and the black ink held in that ink holding member is supplied to the liquid ejecting head 17 via an ink supply tube 29. Note that the ink supply tubes 28 extending from the liquid holding unit 13 and the ink supply tube 29 extending from the liquid holding unit 14 are bundled together partway along within the housing 15, drawn out together in a winding manner, and connected to the liquid ejecting head 17.

As illustrated in FIG. 2, the first ink holding member 25 includes a first ink pack 25*a* configured of a flexible bladder in which cyan ink is held, and a first handle portion 25*b* that is provided on one end portion (an upper end portion) of the first ink pack 25*a* and has an annular rectangular shape. The second ink holding member 26 includes a second ink pack 26*a* configured of a flexible bladder in which magenta ink is held, and a second handle portion 26*b* that is provided on one end portion (an upper end portion) of the second ink pack 26*a* and has an annular rectangular shape.

The third ink holding member 27 includes a third ink pack 27*a* configured of a flexible bladder in which yellow ink is held, and a third handle portion 27*b* that is provided on one end portion (an upper end portion) of the third ink pack 27*a* and has an annular rectangular shape. When filled with ink, the first-third ink packs 25*a*-27*a* have convex surface shapes in which the outer surface shapes thereof bulge in a curved manner.

Figure 3:
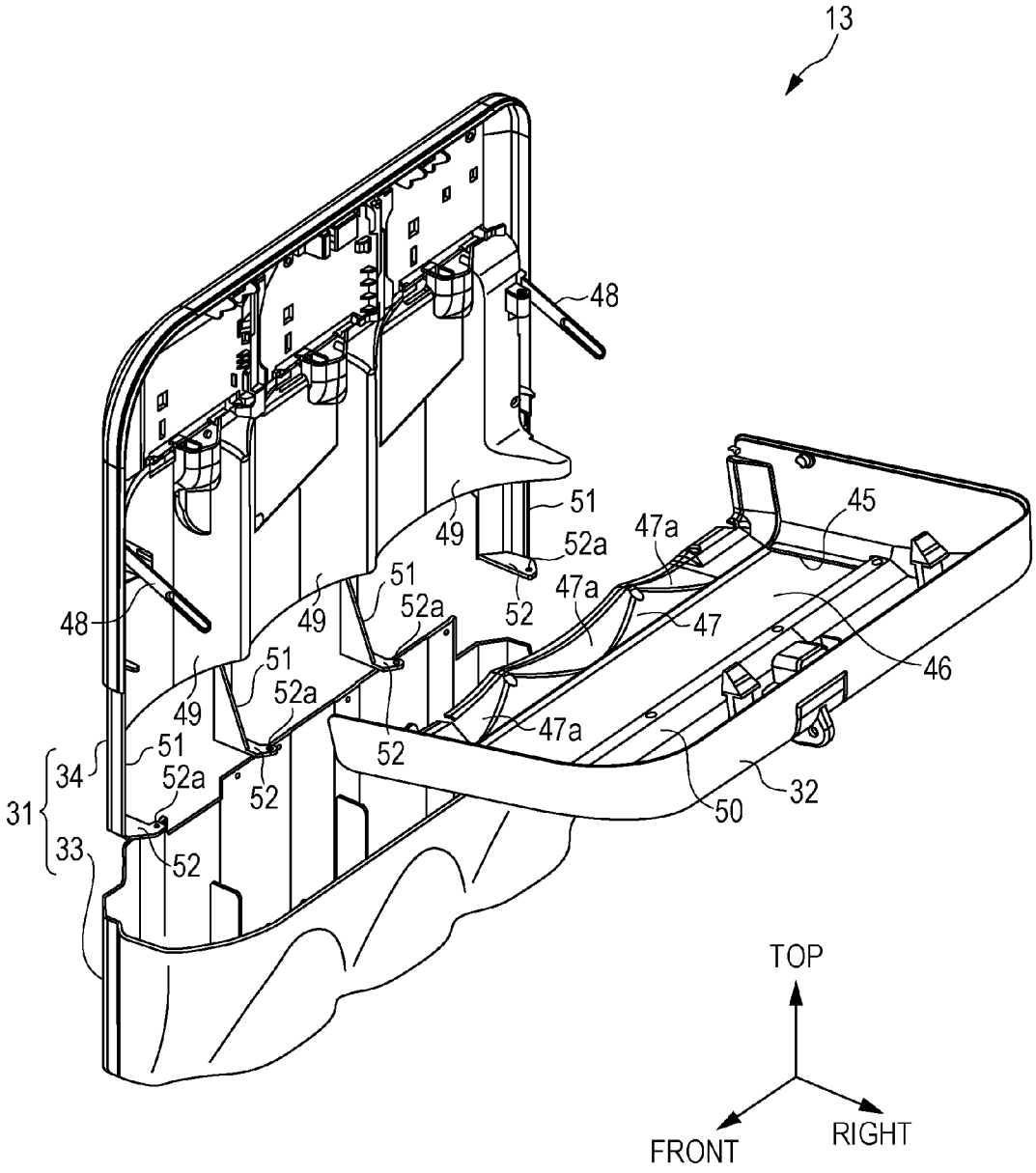
FIG. 3 is an exploded perspective view of a liquid holding unit.

As illustrated in FIGS. 2 and 3, the liquid holding unit 13 is configured of a synthetic resin, and includes a case 31 and a cover member 32 capable of opening and closing the case 31. The case 31 includes a liquid receptacle portion 33 serving as an example of a case forming member configuring a closed-base box member that forms a base portion of the case 31, and an approximately rectangular plate-shaped side wall forming member 34 that is connected to the top of a left side wall of the liquid receptacle portion 33, which serves as a side wall toward the housing 15 (see FIG. 1), and has a given depth.

Figure 7:
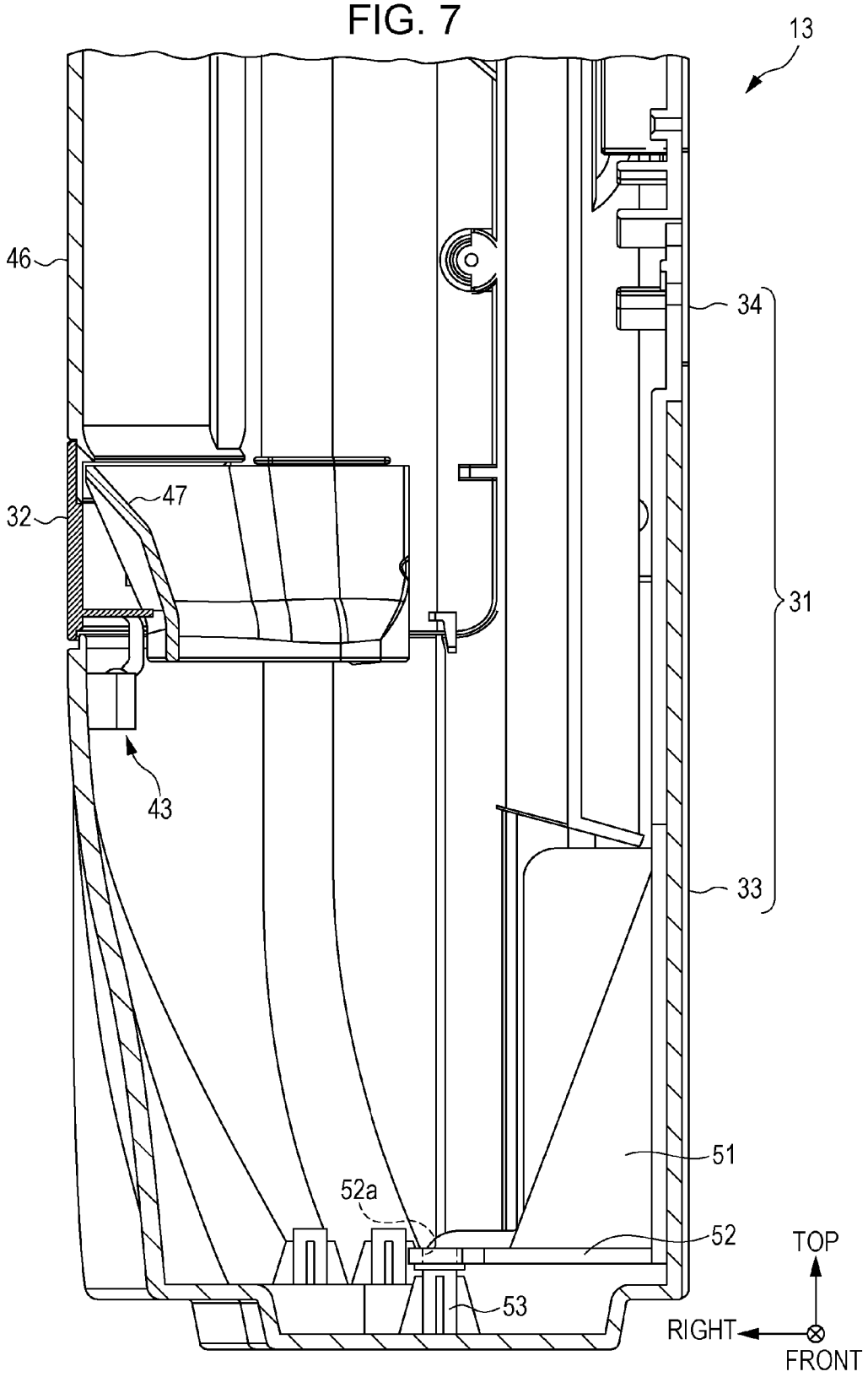
FIG. 7 is an enlarged cross-sectional view of primary components of a liquid holding unit in a state where a cover member is closed.

As illustrated in FIGS. 3 and 7, four foot portions 51, each having an approximately L-shaped plate shape and inserted into the liquid receptacle portion 33, are provided extending downward in a lower end portion of the side wall forming member 34. The four foot portions 51 are disposed at intervals in the front-back direction, respectively, and a base plate portion 52 is provided in a leading end portion (a lower end portion) of each. A screw through-hole 52*a* through which a screw (not shown) can be passed is formed in each base plate portion 52.

Approximately cylindrical boss portions 53 are provided in a protruding manner on an inner base surface of the liquid receptacle portion 33, in positions corresponding to the four screw through-holes 52*a* of the side wall forming member 34. A screw-hole (not shown) into which a screw (not shown) can be threaded is provided in each of the boss portions 53. The side wall forming member 34 is anchored to the liquid receptacle portion 33 by aligning the screw through-holes 52*a* of the four foot portions 51 in the side wall forming member 34 with the screw-holes (not shown) of the four boss portions 53 in the liquid receptacle portion 33, passing screws (not shown) through the respective screw through-holes 52*a*, and tightening the screws into the screw-holes (not shown) of the boss portions 53.

Accordingly, it is not necessary to form screw-holes (not shown) in a base wall of the liquid receptacle portion 33, and thus even in the case where ink has leaked from the first-third ink holding members 25-27 within the case 31, the leaked ink can be suppressed from leaking from the liquid receptacle portion 33 to the exterior.

Figure 5:
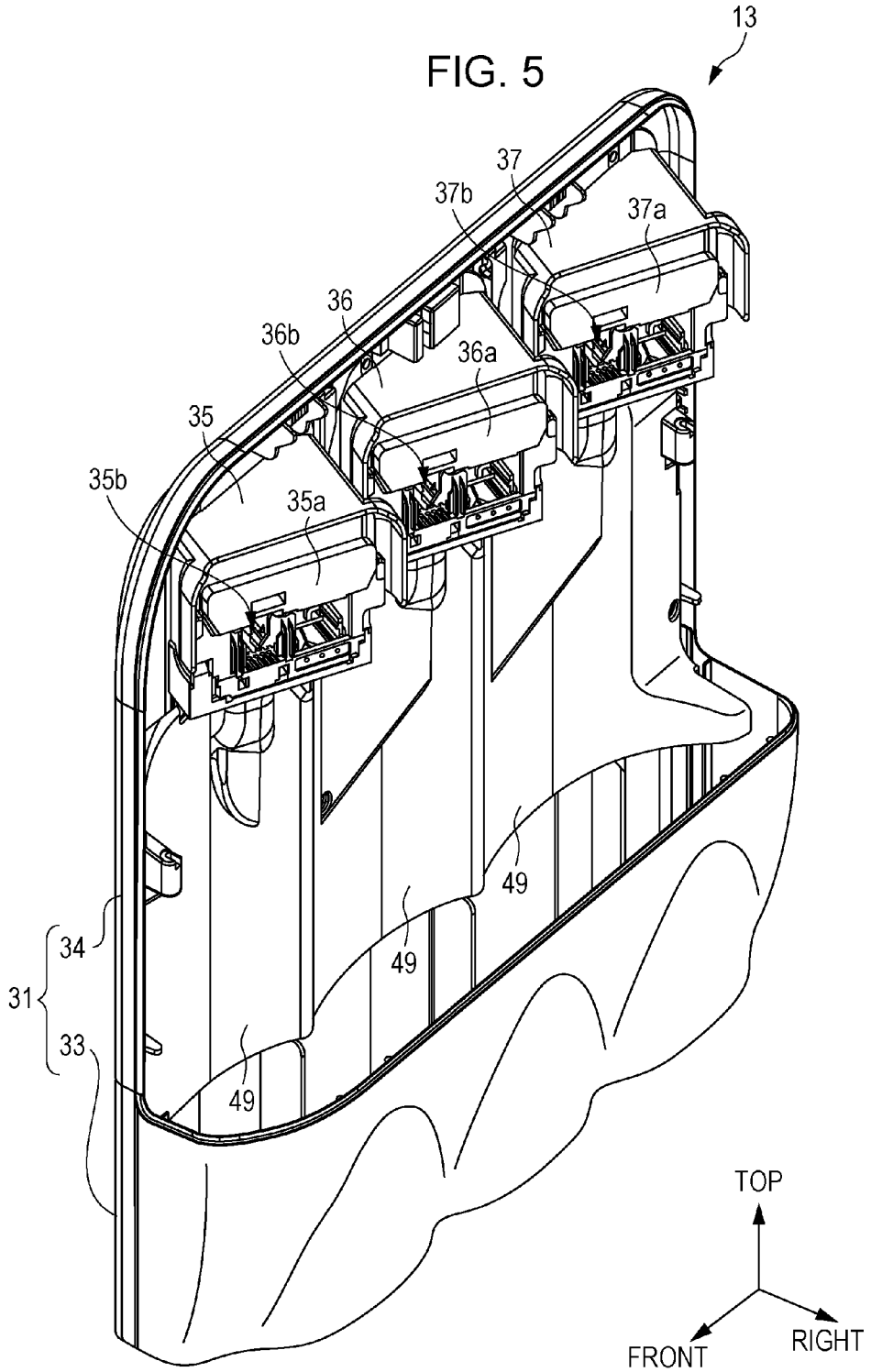
FIG. 5 is a perspective view of a liquid holding unit when a cover member is not illustrated.

As illustrated in FIGS. 2 and 5, a first support member 35, a second support member 36, and a third support member 37 that support the respective first-third ink holding members 25-27 are provided in an upper end portion of the side wall forming member 34 within the case 31, so as to be arranged in the front-back direction. The first-third support members 35-37 project forward at an angle within the case 31. The ink supply tubes 28 (see FIG. 1), which are connected at one end to the liquid ejecting head (see FIG. 1), are connected at another end to the first-third support members 35-37, respectively.

An approximately rectangular first engagement protruding portion 35*a*, second engagement protruding portion 36*a*, and third engagement protruding portion 37*a* that engage the respective first-third handle portions 25*b*-27*b* of the first-third ink holding members 25-27 are provided in the leading end surfaces of the first-third support members 35-37, respectively. By engaging the first-third handle portions 25*b*-27*b* with the respective first-third engagement protruding portions 35*a*-37*a*, the first-third handle portions 25*b*-27*b* are linked to the respective first-third support members 35-37, and the first-third ink holding members 25-27 are supported by the respective first-third support members 35-37 so as to hang down.

In this state, the first-third ink packs 25*a*-27*a* communicate with the respective ink supply tubes 28 (see FIG. 1) via the respective first-third handle portions 25*b*-27*b* and the respective first-third support members 35-37. The first-third handle portions 25*b*-27*b* have respective discharge openings 25*c*-27*c*, illustrated in FIG. 2, from each of which ink is discharged, and the first-third support members 35-37 have respective connection portions 35*b*-37*b*, illustrated in FIG. 5, that connect with the respective discharge openings 25*c*-27*c*.

Furthermore, in this state, the first-third ink holding members 25-27 are disposed within the case 31 at an angle relative to the side wall forming member 34, and mutually-adjacent first-third ink holding members 25-27 overlap in a direction in which the first-third support members 35-37 protrude.

Further still, in this state, the positions of the first-third ink holding members 25-27 within the liquid receptacle portion 33 of the case 31 serve as set positions for the respective first-third ink holding members 25-27. In other words, the set position of the first ink holding member 25 is a forward area within the liquid receptacle portion 33, the set position of the second ink holding member 26 is a central area in the front-back direction within the liquid receptacle portion 33, and the set position of the third ink holding member 27 is a rearward area within the liquid receptacle portion 33.

Note that a volume of the liquid receptacle portion 33 is set to be no less than an amount equivalent to an amount of ink held in any one of the first-third ink holding members 25-27 when that member is full. In other words, the volume of the liquid receptacle portion 33 is set so that even in the case where the first-third ink holding members 25-27 are full and are held within the case 31, and all of the ink held in any one of the first-third ink holding members 25-27 has leaked out, all of the ink that has leaked out can be held within the liquid receptacle portion 33.

Figure 4:
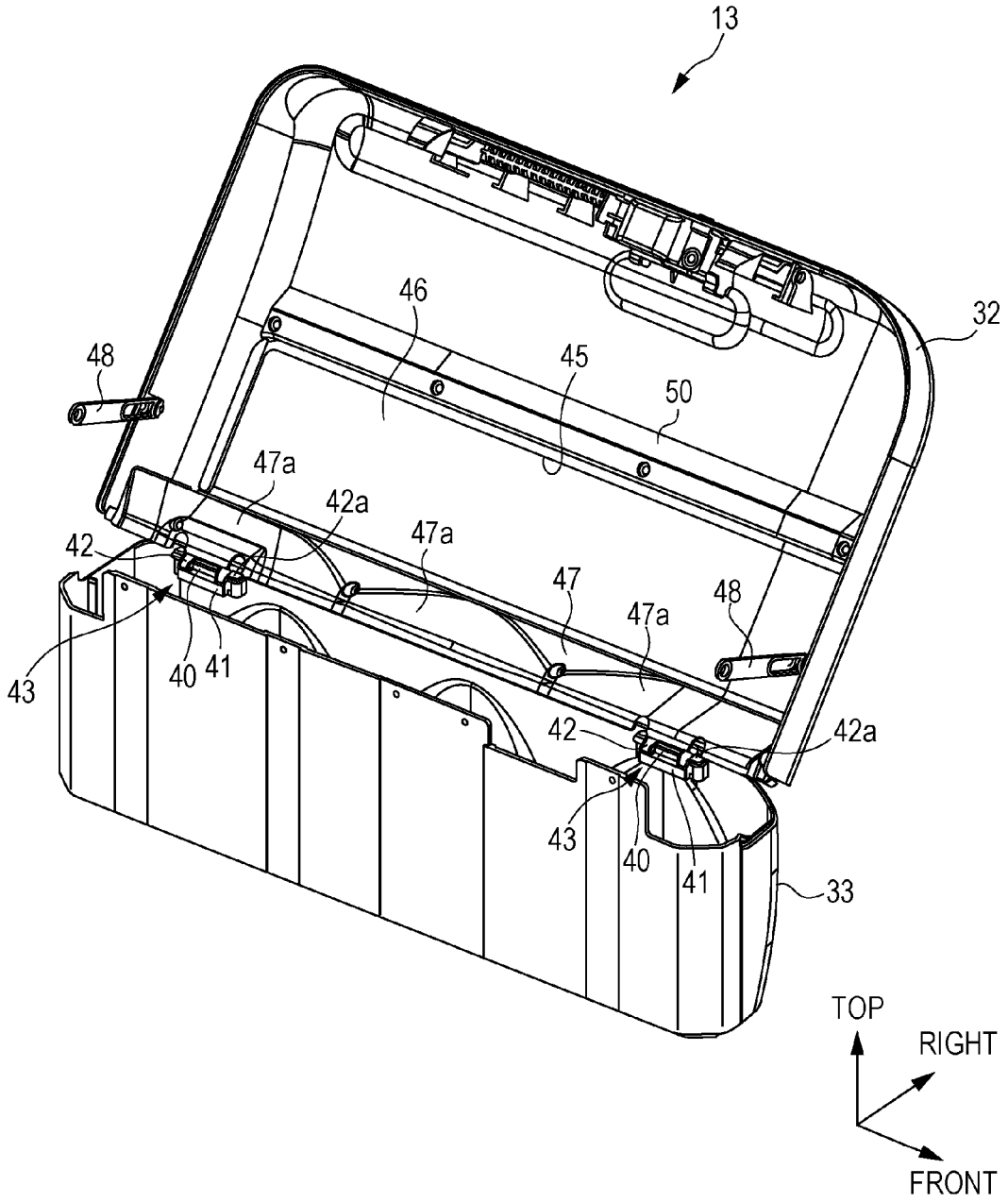
FIG. 4 is a perspective view of a liquid holding unit when a cover member has been opened, in which a side wall forming member is not illustrated.
Figure 6:
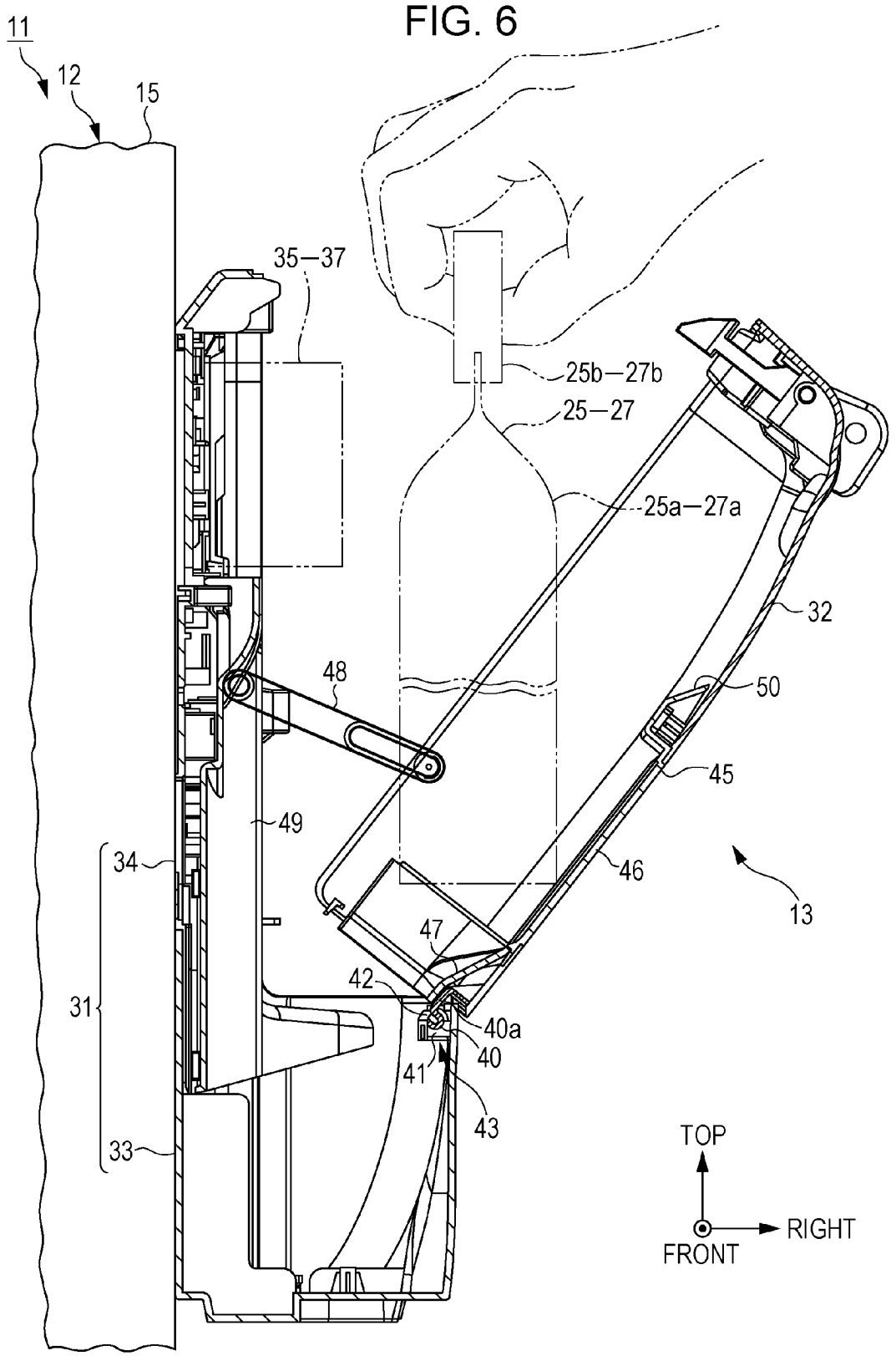
FIG. 6 is a cross-sectional view of a liquid holding unit in a state where a cover member is open.

As illustrated in FIGS. 4 and 6, the cover member 32 has a rectangular plate-shape having a given depth, and a pair of front and rear hinge shafts 40 are provided on a base end portion thereof via an arm portion 40*a*. A pair of front and rear shaft receiving portions 41 are provided in an upper end portion of an inner surface of a right-side wall of the liquid receptacle portion 33, which is a side wall on the side opposite from the side wall forming member 34, so as to support the pair of front and rear hinge shafts 40 in a pivotable state.

The cover member 32 is attached to the liquid receptacle portion 33 by anchoring a pair of holding members 42 to the pair of shaft receiving portions 41 from above the pair of hinge shafts 40 using screws 42*a* in a state in which the pair of hinge shafts 40 are supported by the pair of shaft receiving portions 41. In this embodiment, a hinge portion 43 of the cover member 32 is configured by the pair of hinge shafts 40, the pair of shaft receiving portions 41, and the pair of holding members 42.

Meanwhile, an axis line of the pair of hinge shafts 40 extends in the front-back direction, which is a direction orthogonal to (intersecting with) a vertical direction. The cover member 32 opens and closes the case 31 by pivoting along with the pair of hinge shafts 40, central to the axis line of the pair of hinge shafts 40. A rectangular window 45 that extends across almost the entire front-back direction is formed in the cover member 32 in a position that is slightly closer to the base end side thereof from the central area thereof, and a rectangular plate member 46 formed of a transparent synthetic resin is fixed in the window 45.

A slope 50 serving to suppress the first-third ink holding members 25-27 from catching on the plate member 46 when the first-third ink holding members 25-27 are slid down along the inner surface of the cover member 32 into their respective set positions is formed in an upper side of the plate member 46 on the inner surface of the cover member 32.

A rectangular plate-shaped slide portion 47 that is in adjacent with the window 45 and extends across the entire front-back direction is provided, as a guide portion, in the base end portion (lower end portion) of the cover member 32 on the inner surface thereof. In this case, the slide portion 47 is provided so as to cover the pair of hinge portion 43 and an upper end portion of the right side wall of the liquid receptacle portion 33 when the cover member 32 is open. Guiding portions 47*a*, each having a concave surface shape that corresponds to the outer surface shape of the convex surface-shaped first-third ink packs 25*a*-27*a*, are provided in a surface of the slide portion 47, so as to correspond to the respective set positions of the first-third ink holding members 25-27.

In other words, three (the same number as the first-third ink holding members 25-27 held in the case 31) guiding portions 47*a*, having shapes that correspond to the outer surface shape of the first-third ink packs 25*a*-27*a*, are provided in the surface of the slide portion 47 so as to be arranged in the front-back direction. To rephrase, the surface of the slide portion 47 has a shape that corresponds to the outer surface shapes of the first-third ink packs 25*a*-27*a*.

Meanwhile, a position toward the base end side in the inner surfaces of the front and rear side walls of the cover member 32 is linked to a central area of the inner surface of the front and rear side walls of the side wall forming member 34 by a pair of linking arms 48 that restrict a range across which the cover member 32 can pivot. In this embodiment, the lengths of the pair of linking arms 48 are set so that in the case where an angle of the cover member 32 in a closed state (the state illustrated in FIG. 1) is taken as 0 degrees, the angle of the cover member 32 in an open state (the state illustrated in FIG. 6) is 40 degrees.

In other words, in this embodiment, the cover member 32 is configured to be parallel to a vertical plane in the closed state and to form an angle of 40 degrees with the vertical plane in the open state. To rephrase, in this embodiment, the cover member 32 can pivot between a closed position corresponding to the closed state and an open position corresponding to the open state over an angular range of 0 to 40 degrees.

As illustrated in FIGS. 3 and 5, guide portions 49, serving as visual confirmation portions, that have concave surface shapes corresponding to the outer surface shapes of the convex surface shapes of the first-third ink packs 25*a*-27*a*, are provided within the case 31, in an inner surface of the side wall forming member 34 that faces the slide portion 47 when the cover member 32 is in the closed state, so as to correspond to the respective set positions of the first-third ink holding members 25-27.

In other words, three guide portions 49, corresponding to the number of first-third ink packs 25*a*-27*a* held within the case 31, are provided in the inner surface of the side wall forming member 34, arranged in the front-back direction. The three guide portions 49 indicate positions corresponding to the first-third ink holding members 25-27, and serve as indicators of the set positions of the first-third ink holding members 25-27.

Operations carried out when setting the first-third ink holding members 25-27 in the case 31 will be described next.

As illustrated in FIG. 6, in the case where the first-third ink holding members 25-27 are to be set in the case 31, the cover member 32 is first pivoted and placed in the open state. Upon doing so, the cover member 32 is held in the open position, sloped at an angle relative to the vertical plane, by the pair of linking arms 48. Next, while holding the third handle portion 27*b*, the third ink holding member 27 is placed toward the front of the inner surface of the cover member 32, which corresponds to the set position of the third ink holding member 27, using the guide portion 49 as an indicator. Upon doing so, the third ink holding member 27 slides down toward the slide portion 47 along the inner surface of the cover member 32.

Once the third ink holding member 27 reaches the slide portion 47, the guiding portion 47*a* in the slide portion 47 that corresponds to the third ink holding member 27 allows the third ink holding member 27 to slide while guiding the third ink holding member 27 to the set position thereof. At this time, the hinge portion 43 and the upper end portion of the right side wall of the liquid receptacle portion 33 are covered by the slide portion 47, and thus the third ink holding member 27 slides down to the set position within the liquid receptacle portion 33 without catching on the hinge portion 43, the upper end portion of the right side wall of the liquid receptacle portion 33, or the like. Thereafter, by engaging the third handle portion 27*b* with the third engagement protruding portion 37*a* of the third support member 37, the third ink holding member 27 is set within the case 31 so as to hang downward from the third support member 37.

In the same manner, by engaging the second handle portion 26*b* with the second engagement protruding portion 36*a* of the second support member 36 and engaging the first handle portion 25*b* with the first engagement protruding portion 35*a* of the first support member 35, the first ink holding member 25 and the second ink holding member 26 are set within the case 31 so as to hang downward from the first support member 35 and the second support member 36, respectively. Then, the operation for setting the first-third ink holding members 25-27 in the case 31 is completed by pivoting the cover member 32 into the closed state.

According to the embodiment described in detail thus far, the following effects can be achieved.

1. The slide portion 47, which can allow the first-third ink holding members 25-27 to slide into the set positions within the case 31 when the first-third ink holding members 25-27 are placed in the case 31 with the cover member 32 in the open state, is provided in the inner surface of the cover member 32. Accordingly, by placing the first-third ink holding members 25-27 on the inner surface of the cover member 32 when the first-third ink holding members 25-27 are placed in the case 31, the first-third ink holding members 25-27 can be slid and guided to the set positions in the case 31 by the slide portion 47. Accordingly, the first-third ink holding members 25-27 can be set in the set positions in the case 31 with ease.

2. The slide portion 47 is provided so as to cover the hinge portion 43 of the cover member 32. Accordingly, when sliding the first-third ink holding members 25-27 along the inner surface of the cover member 32 into the set positions in the case 31, the first-third ink holding members 25-27 can be suppressed from catching on the hinge portion 43 of the cover member 32 by the slide portion 47.

3. The cover member 32 is attached to the upper end portion of the liquid receptacle portion 33 of the case 31 via the hinge portion 43, and the slide portion 47 covers the upper end portion of the liquid receptacle portion 33 when the cover member 32 is in an open state. Accordingly, when sliding the first-third ink holding members 25-27 along the inner surface of the cover member 32 into the set positions in the case 31, the first-third ink holding members 25-27 can be suppressed from catching on the upper end portion of the liquid receptacle portion 33 by the slide portion 47.

4. The liquid receptacle portion 33 of the case 31 has a closed-base box shape, and thus there are no seams (that is, the portion is seamless). Accordingly, in the case where the first-third ink holding members 25-27 have ruptured within the case 31 and the ink therein is leaked out, the leaked ink can be held by the liquid receptacle portion 33. Accordingly, the ink that has leaked out from the first-third ink holding members 25-27 within the case 31 can be suppressed from flowing out to the exterior of the case 31. Incidentally, in the case where the liquid receptacle portion 33 is configured by assembling a plurality of members, it is easy for ink that has leaked within the liquid receptacle portion 33 to leak out through seams between the respective members.

5. The guide portions 49, indicating positions that correspond to the first-third ink holding members 25-27, are provided in the inner surface of the side wall forming member 34 that faces the slide portion 47 within the case 31. Accordingly, by using the guide portions 49 as indicators when setting the first-third ink holding members 25-27 in the set positions within the case 31, the first-third ink holding members 25-27 can be precisely set in the set positions within the case 31.

6. The surface of the slide portion 47 has a shape that corresponds to the outer surface shape of the first-third ink packs 25*a*-27*a*. Accordingly, a gap between the outer surfaces of the first-third ink packs 25*a*-27*a* and the surface of the slide portion 47 when the first-third ink packs 25*a*-27*a* are placed in the set positions within the case 31 and the cover member 32 is closed can be reduced, which makes it possible to conserve space.

7. The three guiding portions 47*a* that have shapes corresponding to the outer surface shapes of the first-third ink packs 25*a*-27*a* are provided in the surface of the slide portion 47 so as to be arranged in the front-back direction. Accordingly, when the first-third ink holding members 25-27 are slid along the inner surface of the cover member 32 and the first-third ink holding members 25-27 are moved to the slide portion 47, the first-third ink holding members 25-27 can be guided and slid to the respective set positions by the guiding portions 47*a* in the slide portion 47 that correspond to the first-third ink holding members 25-27. The first-third ink holding members 25-27 can therefore be precisely set in the set positions in the case 31 with ease.

8. The slide portion 47 is disposed in a position on the inner surface of the cover member 32 that does not overlap with the window 45. Accordingly, the slide portion 47 does not interfere when viewing the first-third ink holding members 25-27 placed in the liquid holding unit 13 from outside the liquid holding unit 13 through the window 45 in order to confirm the respective remaining ink amounts.

9. The hinge portion 43 is disposed on the inside surface of the liquid receptacle portion 33. Accordingly, the hinge portion 43 does not protrude from the outer surface of the case 31, which makes it possible to improve the external appearance of the case 31 (the liquid holding unit 13).

10. The guide portions 49 have concave surface shapes that correspond to the outer surface shapes in the convex surface shapes of the first-third ink packs 25*a*-27*a*, and thus the set positions of the first-third ink holding members 25-27 can be visually recognized with ease.

11. The volume of the liquid receptacle portion 33 is set so that even in the case where the full first-third ink holding members 25-27 are held within the case 31 and all of the ink held in any one of the first-third ink holding members 25-27 has leaked out, all of the ink that has leaked out can be held in the liquid receptacle portion 33. In other words, even if the ink has leaked out from any one of the full first-third ink holding members 25-27 within the case 31, the ink that has leaked out can be held within the liquid receptacle portion 33. Accordingly, ink that has leaked out within the case 31 can be effectively suppressed from flowing out from the case 31.

12. The first-third ink holding members 25-27 are disposed within the case 31 at an angle relative to the side wall forming member 34, and mutually-adjacent first-third ink holding members 25-27 overlap in the direction in which the first-third support members 35-37 protrude. Accordingly, a width of the case 31 (the liquid holding unit 13) in the front-back direction can be kept smaller than in the case where the first-third ink holding members 25-27 are disposed parallel to the side wall forming member 34 in the case 31 and arranged in the front-back direction so that the first-third ink holding members 25-27 do not overlap with each other in the left-right direction.

13. Normally, in the case where the cover member 32 is to be opened wide in a predetermined pivoting range, it is necessary to lower the position of the hinge portion 43 of the cover member 32. However, it is necessary to provide the hinge portion 43 in the upper end portion of the liquid receptacle portion 33, and thus the depth of the liquid receptacle portion 33 will decrease if the position of the hinge portion 43 is lowered excessively. With respect to this point, in this embodiment, the first-third ink holding members 25-27 can be slid and guided to the set positions within the case 31 by the slide portion 47, and thus even if the pivoting range of the cover member 32 is narrowed and the amount by which the cover member 32 opens is reduced, the ease with which the first-third ink holding members 25-27 can be set in the set positions can be maintained. Accordingly, the position of the hinge portion 43 of the cover member 32 can be raised, and thus the liquid receptacle portion 33 can be set to be deep, which is advantageous in terms of holding ink that has leaked out from the first-third ink holding members 25-27 in the case 31 within the liquid receptacle portion 33. Furthermore, the amount by which the cover member 32 opens can be reduced, which makes it possible to reduce the amount of space necessary to open/close the cover member 32.

Second Embodiment

A second embodiment will be described with reference to FIGS. 8 through 11. As illustrated in FIG. 11, a recording apparatus 11*a* according to this embodiment differs from the recording apparatus 11 according to the first embodiment in that the liquid receptacle portion 33 in the recording apparatus 11*a* has contact portions 180.

Figure 8:
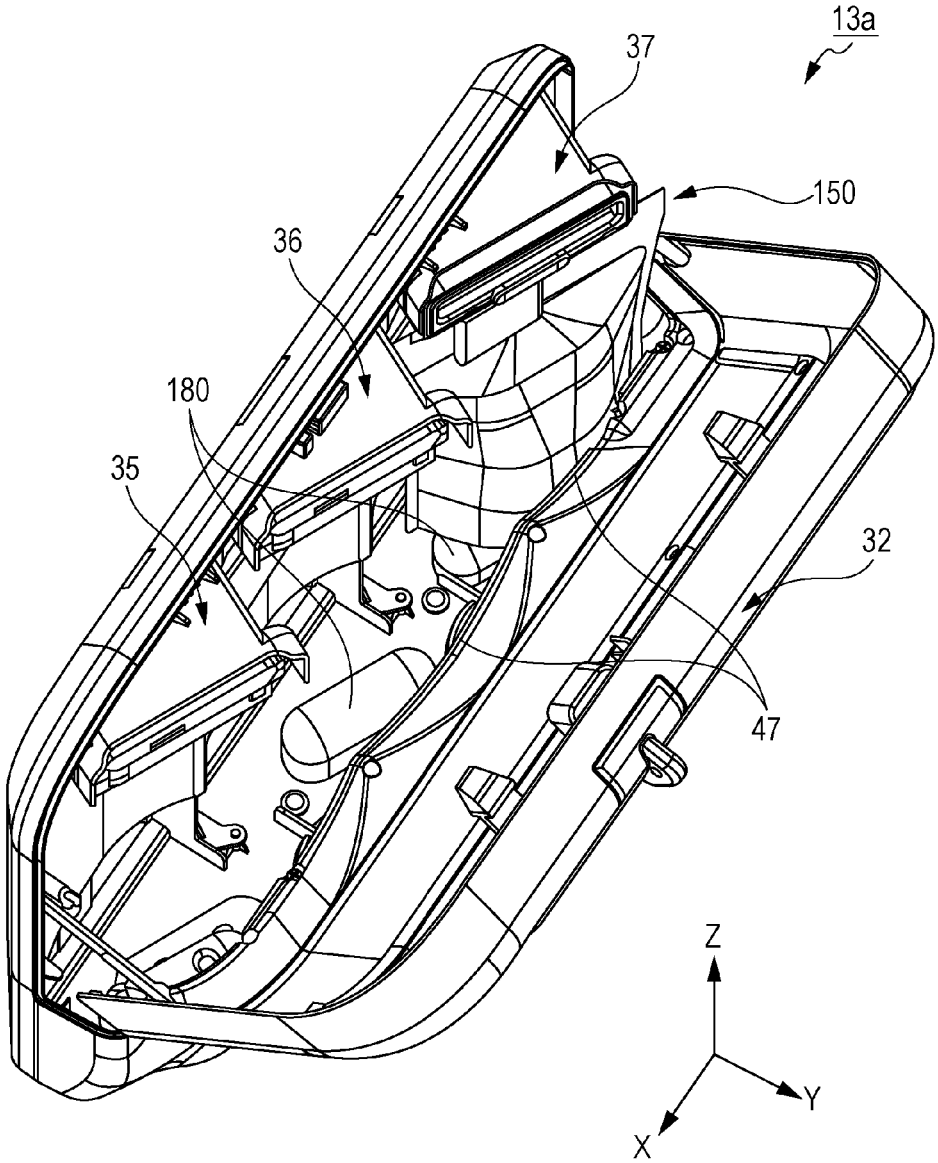
FIG. 8 is a perspective view of a liquid holding unit when a cover member has been opened, according to a second embodiment.

FIG. 8 is a perspective view of a liquid holding unit 13*a* when the cover member 32 is open. FIG. 8 illustrates a state in which a single liquid holding member 150 is held in the liquid holding unit 13*a*. The liquid holding unit 13*a* includes the slide portions 47 and the contact portions 180. The slide portions 47 and contact portions 180 are provided for each of mounting units (support members) 35, 36, and 37. The contact portions 180 are provided integrally with the liquid receptacle portion 33. The contact portions 180 make contact with corresponding liquid holding members 150 in a state where the liquid holding members 150 are mounted on the respective mounting units 35, 36, and 37. The contact portions 180 have convex shapes (convex curved surfaces) or projections, as illustrated in FIG. 8, so as to suppress the liquid holding members 150 from being damaged.

When a user inserts the liquid holding members 150 into the liquid holding unit 13*a* from the exterior with the cover member 32 in an open state, the slide portions 47 guide that insertion. This guiding is executed by a third film 523 (see FIG. 9), which serves as a base portion of the liquid holding members 150, making contact with the contact portions 180. The slide portions 47 have a curved, concave shape for this guiding, as illustrated in FIG. 8.

Configuration of Liquid Holding Members 150

Figure 9:
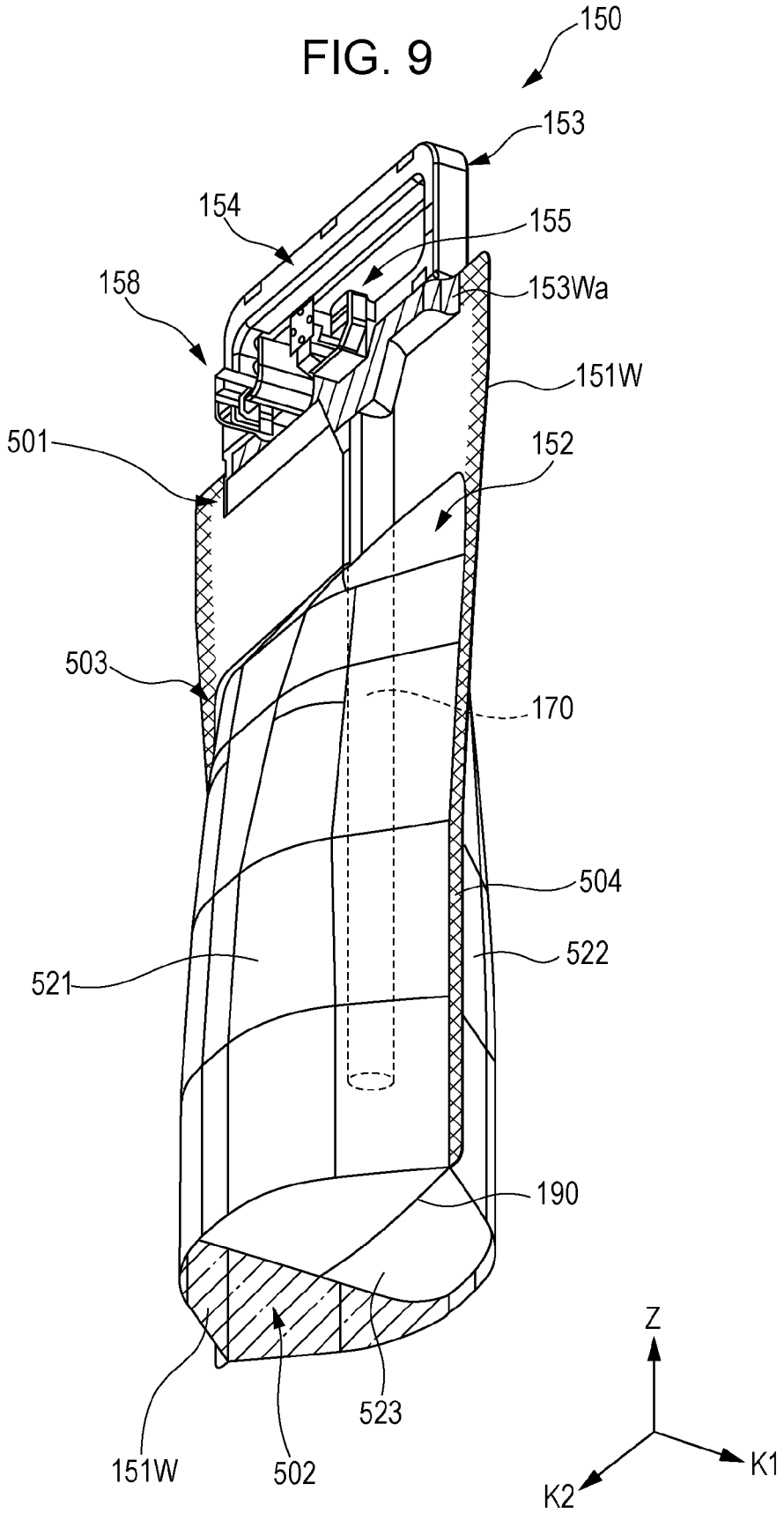
FIG. 9 is a perspective view illustrating the external appearance of a liquid holding member.
Figure 10:
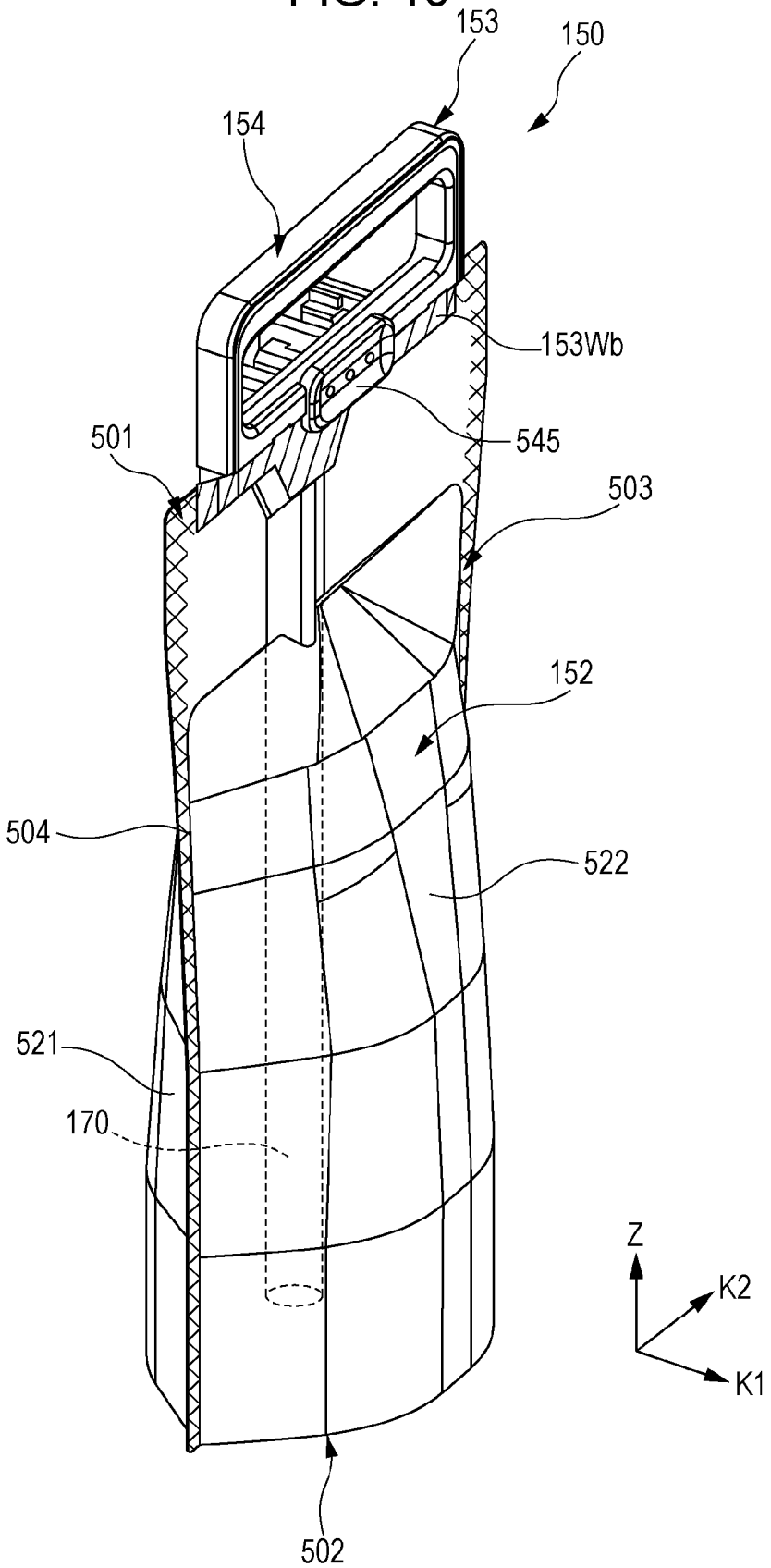
FIG. 10 is a perspective view illustrating the external appearance of a liquid holding member.
Figure 11:
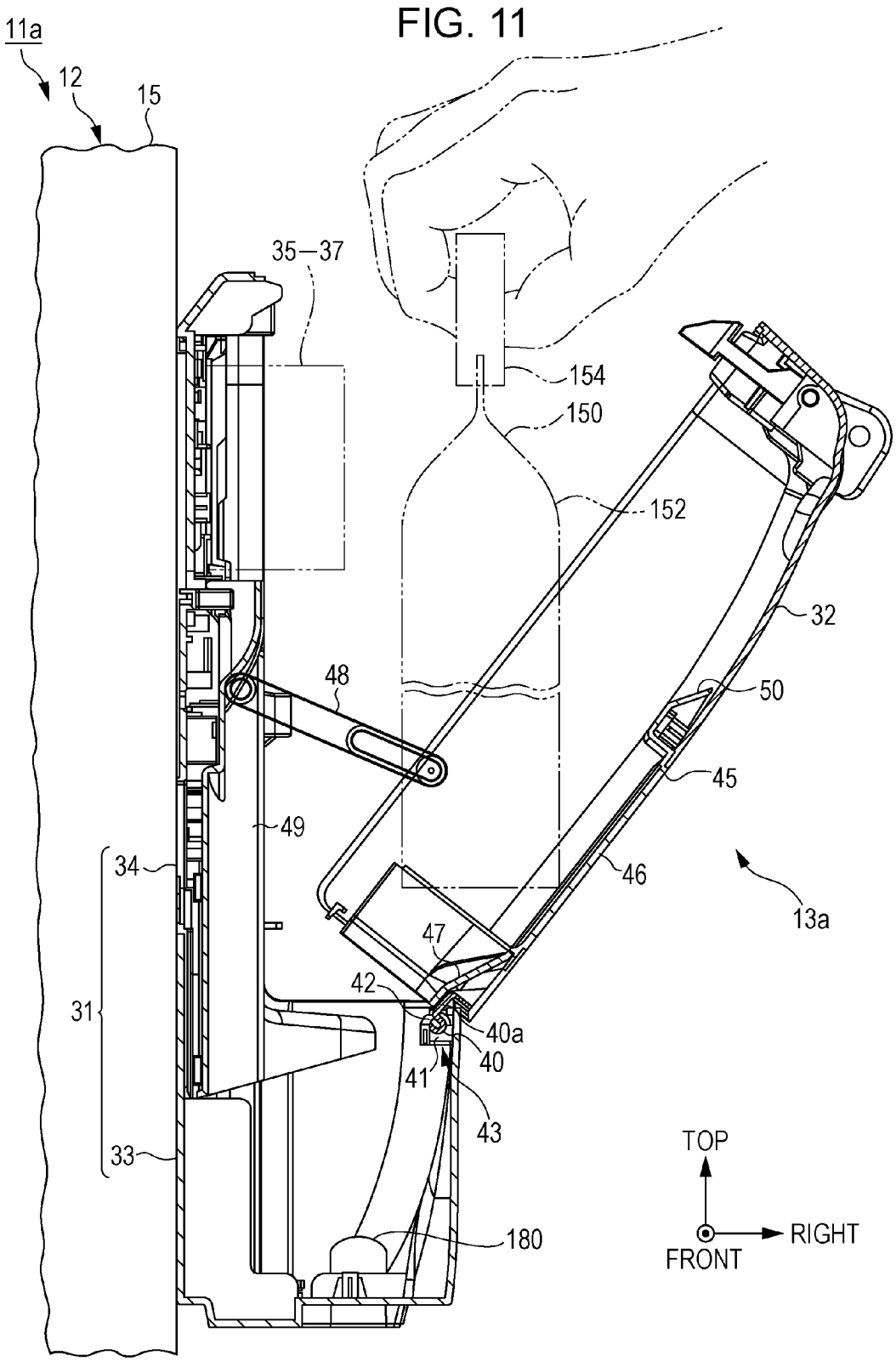
FIG. 11 is a cross-sectional view of a liquid holding unit in a state where a cover member is open, according to the second embodiment.

FIGS. 9 and 10 are perspective views illustrating the external appearance of the liquid holding members 150. FIG. 9 is a front view illustrating the external appearance of the liquid holding members 150. FIGS. 9 and 10 illustrate a Z axis, a K1 axis, and a K2 axis for a state in which the liquid holding members 150 are mounted to the mounting units 35, 36, and 37 (a mounted state). The Z axis is the same as the Z axis illustrated in FIG. 8.

FIGS. 9 and 10 illustrate a state in which the members are filled with ink, before being mounted to the mounting units 35, 36, and 37. As illustrated in FIGS. 9 and 10, each of the liquid holding members 150 includes a liquid holding bladder (ink pack) 152 and an operating member 153. The operating member 153 includes a grip portion 154, a liquid supply unit 155 serving as a discharge opening, a board unit 158, and a pressure portion 545. The grip portion 154 is a portion by which a user grips the liquid holding member 150.

The liquid holding bladder 152 is capable of holding ink. The liquid holding bladder 152 is attached to the operating member 153 in a state in which a surface of the bladder is exposed. In other words, the liquid holding bladder 152 is not held within a case or the like, and is configured to be visible from the exterior.

Of the liquid holding bladder 152, a side that is attached to the operating member 153 is defined as a side on one end 501, and the side opposite from the one end 501 is defined as a side on another end 502. Furthermore, of the liquid holding bladder 152, an end on a +K2 axis direction side is defined as a first side end 503, and an end on a −K2 axis direction side is defined as a second side end 504.

As illustrated in FIG. 9, the liquid supply unit 155 and the board unit 158 are positioned on the side of the one end 501 of the liquid holding bladder 152. Also as illustrated in FIG. 9, when the liquid holding member 150 is viewed along the K1 axis direction, the liquid supply unit 155 and the board unit 158 are positioned so as to at least partially overlap with the one end 501. In other words, respective lower ends of the liquid supply unit 155 and the board unit 158 are positioned further in the −Z axis direction than an upper end of the one end 501.

The liquid holding bladder 152 includes a first film 521, a second film 522 (FIG. 9), and a third film 523. The first-third films 521-523 define a space for holding ink therein. As illustrated in FIGS. 9 and 10, the first film 521 and the second film 522 configure side surfaces of the liquid holding bladder 152. As illustrated in FIG. 9, the third film 523 configures the base surface of the liquid holding bladder 152. The first film 521 and the second film 522 are disposed so as to face each other. The first film 521 and the second film 522 are partially welded together at a peripheral edge region 151W. To be more specific, of the peripheral edge region 151W, an area on the side of the one end 501, an area on the side of the first side end 503, and an area on the second side end 504 are welded together. The crosshatching illustrated in FIGS. 9 and 10 indicates the areas where the first and second films 521 and 522 are welded together.

The one end 501 of the liquid holding bladder 152 (and specifically, one end of the first and second films 521 and 522) is welded to a joining portion (not shown) of the operating member 153. The solid-line single hatching illustrated in FIGS. 9 and 10 indicates peripheral regions 153Wa and 153Wb, which are the areas of the operating member 153 and the first and second films 521 and 522 that are welded together.

The third film 523 is partially welded, at the peripheral edge region 151W of the third film 523 and at the peripheral edge region 151W of the first film 521 and the second film 522. The dot-dash line single hatching illustrated in FIG. 9 indicates the areas where the third film 523 is welded to the first and second films 521 and 522. The third film 523 functions as a base portion.

The first-third films 521-523 are each flexible. Polyethlene terephthalate (PET), nylon, polyethylene, or the like, for example, is used as the material of the first-third films 521-523. Due to this flexibility, the liquid holding bladder 152 decreases in internal volume as the amount of ink held therein drops.

The liquid holding member 150 includes a flow channel member 170 for allowing the ink held in the liquid holding bladder 152 to flow into the liquid supply unit 155. The flow channel member 170 is disposed on the inner side of the liquid holding bladder 152.

A crease 190 is provided in the third film 523. The crease 190 is provided so as to connect the first side end 503 and the second side end 504. When the internal volume of the liquid holding bladder 152 decreases, the third film 523 folds along the crease 190 due to the contact portion 180. The decrease in the internal volume of the liquid holding bladder 152 progresses smoothly as a result of the third film 523 folding in this manner. The amount of residual ink is reduced as a result. Residual ink refers to ink that remains within the liquid holding bladder 152 that is removed (detached) when the liquid holding member 150 is replaced.

Variations

Note that the aforementioned embodiment may be modified as described hereinafter.

The cover member 32 may be configured so that the lengths of the pair of linking arms 48 are set so that the angle in the open state (the state illustrated in FIG. 6) is less than 90 degrees and the cover member 32 can pivot between the closed position and the open position over an angular range that is no less than 0 degrees and less than 90 degrees. However, it is necessary to set the angle of the cover member 32 in the open state (the state illustrated in FIG. 6) so that the cover member 32 opens to an extent that enables the first-third ink holding members 25-27 to be held within the case 31.

The shape of the guiding portions 47*a* in the slide portions 47 (the surface shape of the slide portions 47) does not necessarily need to be a shape that corresponds to the outer surface shape of the first-third ink packs 25*a*-27*a*. For example, the shape of the guiding portions 47*a* may be an angular shape.

The guide portions 49 may be omitted.

It is not absolutely necessary for the liquid receptacle portion 33 of the case 31 to have a closed-ended box shape.

It is not absolutely necessary for the slide portions 47 to be disposed so as to cover the upper end portion of the liquid receptacle portion 33.

It is not absolutely necessary for the slide portions 47 to be disposed so as to cover the entire hinge portion 43 of the cover member 32. In other words, the slide portions 47 may be disposed so as to cover only the part that protrudes toward the inner surface of the cover member 32.

The slide portions 47 may be formed in ring shapes so as to completely enclose the first-third ink packs 25*a*-27*a* when viewed from a leading end side (an upper side) of the cover member 32.

A discharge port for discharging ink that has leaked from the first-third ink holding members 25-27 and accumulated in the liquid receptacle portion 33 may be provided in the base portion of the liquid receptacle portion 33. In this case, a plug or the like capable of opening and closing the discharge port is provided in the discharge port.

The hinge portion 43 of the cover member 32 may be provided on the outer side surface of the liquid receptacle portion 33. Doing so makes it possible to ensure that the first-third ink holding members 25-27 do not catch on the hinge portion 43 when the first-third ink holding members 25-27 are set in the case 31.

The hinge portion 43 of the cover member 32 may be disposed so as to protrude from both the inner side surface and the outer side surface of the liquid receptacle portion 33. By doing so, the amount by which the hinge portion 43 projects can be distributed to both the inner side surface and the outer side surface of the liquid receptacle portion 33.

The cover member 32 may be configured so as to cover the hinge portion 43 by increasing the thickness of the cover member 32. In this case, the hinge portion 43 may be disposed on the outer side surface of the liquid receptacle portion 33, or may be disposed on the inner side surface of the liquid receptacle portion 33.

The configuration may be such that the hinge portion 43 is covered by a member aside from the slide portion 47. In other words, it is not absolutely necessary for the hinge portion 43 to be covered by the slide portion 47.

The hinge portion 43 may be disposed outside of the region in which the first-third ink holding members 25-27 are set, in the case 31.

The arm portion 40*a* of the cover member 32 may have a shape that is slightly rounded so that the first-third ink holding members 25-27 slide without catching thereon.

The configuration may be such that the hinge portion 43 and the upper end portion of the liquid receptacle portion 33 are covered by a member aside from the slide portion 47. In other words, it is not absolutely necessary for the hinge portion 43 and the upper end portion of the liquid receptacle portion 33 to be covered by the slide portion 47.

The cover member 32 may be configured so as to overlap with the upper end portion of the liquid receptacle portion 33.

The slide portion 47 may be provided so as to span the entire inner surface of the cover member 32. In this case, it is preferable for at least the portion of the slide portion 47 that covers the window 45 to be formed from a transparent material.

It is not absolutely necessary for the shapes of the guide portions 49 to correspond to the outer surface shapes of the first-third ink packs 25*a*-27*a*. For example, the shapes of the guide portions 49 may be angular shapes.

The volume of the liquid receptacle portion 33 may be set to be greater than or equal to an ink amount equivalent to the total amount held in the first-third ink holding members 25-27.

The first-third ink holding members 25-27 need not be disposed at an angle relative to the side wall forming member 34 within the case 31, and may be disposed so that mutually-adjacent first-third ink holding members 25-27 do not overlap in the direction in which the first-third support members 35-37 protrude.

Discharge tubes for discharging ink may be provided within the respective first-third ink holding members 25-27, and the first-third ink holding members 25-27 may be set in the set positions within the case 31 after connecting the discharge tubes to the respective ink supply tubes 28.

The guide portions 49 may also function as the guiding portions 47*a*, and the guiding portions 47*a* may also function as the guide portions 49.

The guiding portions 47*a* and the guide portions 49 may be set to make contact with the first-third ink holding members 25-27 in a state in which the first-third ink holding members 25-27 have been set in the set positions within the case 31 and the cover member 32 has been placed in a closed state.

The guide portions 49 may be configured of colors, text, symbols, labels, or the like.

The first-third ink holding members 25-27 may be configured as hard cases, formed from a hard synthetic resin or the like, in which ink is held.

The first-third ink holding members 25-27 are not limited to hanging downward within the case 31, and may instead rest in the set positions. In this case, the configuration is such that the ink is discharged from the base portions of the first-third ink holding members 25-27 and introduced into the ink supply tubes 28.

The configuration may be such that the liquid holding unit 14 is omitted and black ink, cyan ink, magenta ink, and yellow ink are introduced into the liquid ejecting head 17 from the liquid holding unit 13.

The configuration may be such that at least one of the first-third ink holding members 25-27 can be refilled with ink.

The arrangement of the liquid holding units 13 and 14 may be reversed.

Although the recording apparatus 11 is described as being configured to handle four colors of ink, namely black ink, cyan ink, magenta ink, and yellow ink, the configuration may be such that the recording apparatus 11 is capable of handling only a single color of ink, two colors of ink, or five or more colors of ink.

The recording medium may be cloth, a plastic film, a CD, or the like instead of the paper P.

The entire disclosure of Japanese Patent Application No.: 2014-025129, filed Feb. 13, 2014 and 2014-051101, filed Mar. 14, 2014 are expressly incorporated by reference herein.

What is claimed is:

1. A recording apparatus comprising:

a housing;

a recording unit, disposed within the housing, that records by ejecting a liquid onto a recording medium;

a case, disposed outside the housing, holding a liquid holding member that holds the liquid to be supplied to the recording unit and has a discharge opening that discharges the liquid in the liquid holding member to the exterior; and a connection portion to which the discharge opening is connected;

wherein the case includes:

a cover member capable of opening and closing the case by pivoting central to an axis line extending in a direction that intersects with a vertical direction; and a guide portion, provided on an inner surface of the cover member, that guides the liquid holding member when the liquid holding member is set in the case with the cover member in an open state so that the discharge opening of the liquid holding member is connected to the connection portion, and wherein when the cover member is in the open state, the inner surface of the cover member is tilted toward the position of the lower end of the liquid holding member of which the discharge opening is connected to the connection portion.

2. The recording apparatus according to claim 1, wherein the guide portion is provided so as to cover at least a part of a hinge portion, in the cover member, that protrudes toward the inner surface when the cover member is in an open state.

3. The recording apparatus according to claim 2, wherein the case includes a case forming member to which the cover member is attached via the hinge portion;

the cover member is affixed to an end portion of the case forming member; and the guide portion covers the end portion of the case forming member when the cover member is in an open state.

4. The recording apparatus according to claim 1, wherein a visual confirmation portion that indicates a position corresponding to the liquid holding member is provided on a surface of the case that faces the guide portion.

5. The recording apparatus according to claim 1, wherein the case includes a contact portion that makes contact with a base portion of the liquid holding member that has been set.

6. The recording apparatus according to claim 5, wherein the base portion is bent by the contact portion making contact with the base portion.

* * * * *